US012123118B2

(12) United States Patent
Bagley

(10) Patent No.: US 12,123,118 B2
(45) Date of Patent: Oct. 22, 2024

(54) SEWING HOPPING FOOT ASSEMBLY

(71) Applicant: Gracewood Management, Inc., West Valley City, UT (US)

(72) Inventor: Jim Matthews Bagley, West Valley City, UT (US)

(73) Assignee: Gracewood Management, Inc., West Jordan, UT (US)

( * ) Notice: Subject to any disclaimer, the term of this patent is extended or adjusted under 35 U.S.C. 154(b) by 0 days.

(21) Appl. No.: 18/550,791

(22) PCT Filed: Mar. 17, 2022

(86) PCT No.: PCT/US2022/071202

§ 371 (c)(1),
(2) Date: Sep. 15, 2023

(87) PCT Pub. No.: WO2022/198226

PCT Pub. Date: Sep. 22, 2022

(65) Prior Publication Data

US 2024/0035216 A1 Feb. 1, 2024

Related U.S. Application Data

(60) Provisional application No. 63/162,062, filed on Mar. 17, 2021.

(51) Int. Cl.
*D05B 29/08* (2006.01)

(52) U.S. Cl.
CPC ..... *D05B 29/08* (2013.01)

(58) Field of Classification Search
CPC ..... D05B 29/06; D05B 29/08; D05B 29/10; D05B 29/12
USPC ..... 112/235
See application file for complete search history.

(56) References Cited

U.S. PATENT DOCUMENTS

| | | | | |
|---|---|---|---|---|
| 31,646 A | | 3/1861 | Moulson | |
| 1,934,190 A | | 11/1933 | Harker | |
| 2,790,404 A | | 4/1957 | Somers et al. | |
| 3,433,192 A | * | 3/1969 | Pingitore et al. | D05B 29/10 112/235 |

(Continued)

FOREIGN PATENT DOCUMENTS

| | | |
|---|---|---|
| CH | 686681 A5 | 5/1996 |
| CN | 201738111 U | 2/2011 |

(Continued)

OTHER PUBLICATIONS

International Search Report and Written Opinion for International Application No. PCT/US2022/071202, dated Jun. 3, 2022, 12 pages.

(Continued)

*Primary Examiner* — Nathan E Durham
(74) *Attorney, Agent, or Firm* — Ryan L. Marshall; Jessica Kiser; Barnes & Thornburg LLP

(57) ABSTRACT

A hopping foot assembly for a sewing machine having a needle comprises a hopping foot base and a hopping foot arm extends axially from the hopping foot base relative to an axis. The hopping foot base is shaped to include an opening that extends axially through the hopping foot base relative to the axis. The hopping foot arm is configured to be coupled to the sewing machine to fix the hopping foot base relative to the sewing machine.

16 Claims, 6 Drawing Sheets

(56) References Cited

U.S. PATENT DOCUMENTS

| | | | | |
|---|---|---|---|---|
| 5,317,981 | A * | 6/1994 | Hashiride | D05B 29/02 112/102.5 |
| 5,515,797 | A * | 5/1996 | Janouschek | D05B 29/08 112/235 |
| 8,234,989 | B2 | 8/2012 | Thomas et al. | |
| 8,453,587 | B2 | 6/2013 | Bagley | |
| 10,407,812 | B2 | 9/2019 | Labes et al. | |
| 10,612,173 | B2 | 4/2020 | Groelz et al. | |
| 2007/0044697 | A1 | 3/2007 | Shomura et al. | |
| 2016/0230323 | A1* | 8/2016 | Nakajima | D05B 29/10 |
| 2020/0181820 | A1 | 6/2020 | Mitchell | |

FOREIGN PATENT DOCUMENTS

| | | | |
|---|---|---|---|
| GB | 2505152 | A | 2/2014 |
| WO | 2022198226 | A1 | 9/2022 |

OTHER PUBLICATIONS

International Preliminary Report on Patentability for International Application No. PCT/US2022/071202, dated Sep. 28, 2023, 7 pages.

Stormshopping; "Multifunctional Daisy Flower Stitch Circles Embroidery Presser Foot for Singer Brother Janome and Other Low Shank Sewing Machine by Stormshopping"; Retrieved from: https://www.amazon.com/Multifunctional-Circles-Embroidery-Presser-Stormshopping/dp/B072LW3W38 ; Available at least as early as Oct. 8, 2020; 9 pages.

Handi Quilter, Inc; "Handi Quilter Echo Feet Kit"; Retrieved from: https://www.amazon.com/Handi-Quilter-Echo-Feet-Kit/dp/B075R9MW5K ; Available at least as early as Oct. 8, 2020; 7 pages.

Brother; "Free Motion Echo Quilting Foot, Brother #XE0766001"; Retrieved from: https://www.sewingpartsonline.com/free-motion-echo-quilting-foot-brother-xe0766001.aspx?gclid=EA1a1QobChMI26WQze-g7AIVjf7jBx1eBwSvEAQYBiABEgLGzvD_BwE on Oct. 6, 2020; 6 pages.

Johnson, Liz; "Janome Clear View Quilting Foot and Guide Set"; Retrieved from: https://sew4home.com/accessories-we-love-clear-view-quilting-foot-and-guide-set-from-janome/ ; Aug. 21, 2018; 15 pages.

Martelli Enterprises , "Bella Sedere—Presser Feet Demo", Retrieved from: https://www.youtube.com/watch?v=he-LInIAoJQ, Uploaded Feb. 17, 2016.

* cited by examiner

SEWING HOPPING FOOT ASSEMBLY

CROSS REFERENCE TO RELATED APPLICATIONS

This application is a National Stage application of International Application No. PCT/US2022/071202 filed 17 Mar. 2022, which claims priority to and the benefit of U.S. Provisional Patent Application No. 63/162,062, filed 17 Mar. 2021, the disclosures of which are now expressly incorporated herein by reference.

FIELD OF DISCLOSURE

The present disclosure relates generally to sewing or quilting machines, and more specifically to a hopping foot for sewing or quilting machines.

BACKGROUND

Sewing machines are used for stitching one or more pieces of fabric with thread. Some sewing machines are stationary such that fabric is fed under a needle of the sewing machine, while other sewing machines, like quilting machines, are maneuverable such that the needle may be moved across the fabric.

Maneuverable sewing machines allow a user to create intricate patterns with the stitching. Such sewing or quilting machines, however, may also make it difficult to accurately follow a path on the fabric, such as a seam, a ditch line, or another desired pattern.

Therefore, a hopping foot and a ruler may be used with the sewing machine to help guide the needle along the path. It may be difficult, however, to maneuver the machine and the ruler simultaneously.

SUMMARY

The present disclosure may comprise one or more of the following features and combinations thereof.

A hopping foot assembly for a sewing machine having a needle may comprise a circular hopping foot base, a hopping foot arm, and a rotating guide. The hopping foot arm may extend axially from the hopping foot base relative to an axis. The hopping foot arm may be configured to be coupled to the sewing machine to fix the hopping foot base relative to the sewing machine. The rotating guide may be coupled to the hopping foot base in an opening of the hopping foot base.

In some embodiments, the circular hopping foot base may be shaped to include a top surface, a bottom surface, and the opening. The bottom surface may be spaced apart from the top surface that faces fabric to be sewn. The opening may extend axially through the top and bottom surfaces relative to an axis.

In some embodiments, the rotating guide may be shaped to include a needle opening. The needle opening may be configured to allow the needle to extend into and out of fabric during use of the sewing machine.

In some embodiments, the rotating guide may be configured to rotate about the axis relative to the hopping foot base in response to movement of one of the fabric and the sewing machine. The rotating guide may rotate about the axis to allow a user to align the needle of the sewing machine with a path to be stitched in the fabric during use of the sewing machine.

In some embodiments, the rotating guide may comprise a bearing, a guide insert, and a passive drive system. The bearing may be coupled to the hopping foot base. The bearing may be configured to rotate about the axis and may be shaped to define an inner opening. The guide insert may be configured to be selectively coupled to the inner opening of the bearing. The passive drive system may be coupled to the bearing and configured to cause the bearing to rotate.

In some embodiments, the guide insert may be shaped to define the needle opening and a plurality of guide lines. The plurality of guide lines may be configured to be aligned with the path to allow the user to follow the path with the needle. In some embodiments, the passive drive system may be configured to cause the bearing to rotate so that at least one guide line of the plurality of guide lines included in the guide insert remains aligned with the path as the user moves one of the fabric and the sewing machine during use of the sewing machine.

In some embodiments, the passive drive system may comprise a chassis, a wheel, and a spring. The chassis may be coupled to the bearing. The wheel may be coupled to the chassis. The wheel may be configured to rotate about a wheel axis perpendicular to the axis of the rotating guide. The spring may be located between the bearing and the chassis. The spring may be configured to bias the wheel into engagement with the fabric during use of the sewing machine.

In some embodiments, the bearing may include an outer race, an inner race, and a roller. The inner race may define the inner opening. The roller may be located between the outer race and the inner race. In some embodiments, the hopping foot base may be the outer race of the bearing.

In some embodiments, the inner race of the bearing may include a pointer and the hopping foot base may be shaped to include a plurality of angular indicators. The angular indicators may be configured to be aligned with the pointer of the rotating guide so that the user may follow the path that extends at an angle. In some embodiments, the guide insert may be transparent.

In some embodiments, the rotating guide may comprise a bearing and a passive drive system. The bearing may be coupled to the hopping foot base. The bearing may be configured to rotate about the axis. The passive drive system may be coupled to the bearing. The passive drive system may be configured to cause the bearing to rotate.

In some embodiments, the bearing may be shaped to define a pointer. The passive drive system may be configured to cause the bearing to rotate so that the pointer included in the bearing remains aligned with the path as the user moves one of the fabric and the sewing machine during use of the sewing machine.

In some embodiments, the bearing may include an outer race, an inner race, and a roller. The roller may be located between the outer race and the inner race. In some embodiments, the hopping foot base may be the outer race of the bearing.

In some embodiments, the rotating guide may further comprise a guide insert. The guide insert may be configured to be selectively coupled to the inner race of the bearing.

In some embodiments, the guide insert may be shaped to define the needle opening and a plurality of guide lines. The guide lines may be configured to be aligned with the path to allow the user to follow the path with the needle.

In some embodiments, the passive drive system may comprise a chassis, a wheel, and a spring. The chassis may be coupled to the bearing. The wheel may be coupled to the chassis opposite the pointer. The wheel may be configured to rotate about a wheel axis perpendicular to the axis of the rotating guide. The spring may be located between the bearing and the chassis. The spring may be configured to bias the wheel into engagement with the fabric during use of the sewing machine.

In some embodiments, the rotating guide may comprise a bearing coupled to the hopping foot base and a guide insert. The bearing may be configured to rotate about the axis. The bearing may be shaped to define an inner opening. The guide insert may be configured to be selectively coupled to the inner opening of the bearing.

In some embodiments, the guide insert may be shaped to define the needle opening and a plurality of guide lines. The guide lines may be configured to be aligned with the path to allow the user to follow the path with the needle.

According to another aspect of the present disclosure, a hopping foot assembly for a sewing machine having a needle may comprise a hopping foot base, a hopping foot arm, and a rotating guide. The hopping foot base may be shaped to include an opening that extends axially through the hopping foot base relative to an axis. The hopping foot arm may extend axially from the hopping foot base relative to the axis. The hopping foot arm may be configured to be coupled to the sewing machine to fix the hopping foot base relative to the sewing machine. The rotating guide may be coupled to the hopping foot base in the opening of the hopping foot base.

In some embodiments, the rotating guide may be shaped to include a needle opening. The rotating guide may be configured to allow the needle to extend into and out of fabric during use of the sewing machine. In some embodiments, the rotating guide may be configured to rotate about the axis relative to the hopping foot base in response to movement of one of the fabric and the sewing machine.

In some embodiments, the rotating guide may comprise a bearing, a guide insert, and a passive drive system. The bearing may be coupled to the hopping foot base and may be configured to rotate about the axis. The bearing may be shaped to define an inner opening. The guide insert may be configured to be selectively coupled to the inner opening of the bearing. The passive drive system may be coupled to the bearing and may be configured to cause the bearing to rotate.

In some embodiments, the guide insert may be shaped to define the needle opening and a plurality of guide lines. The guide lines may be configured to be aligned with a path on the fabric to allow a user to follow a path to be stitched in the fabric with the needle.

In some embodiments, the passive drive system may be configured to cause the bearing to rotate so that at least one guide line of the plurality of guide lines included in the guide insert remains aligned with the path as the user moves one of the fabric and the sewing machine during use of the sewing machine. In some embodiments, the guide insert may be transparent.

In some embodiments, the passive drive system may comprise a chassis, a wheel, and a spring. The chassis may be coupled to the bearing. The wheel may be coupled to the chassis and may be configured to rotate about a wheel axis perpendicular to the axis of the rotating guide. The spring may be located between the bearing and the chassis and may be configured to bias the wheel into engagement with the fabric during use of the sewing machine.

In some embodiments, the bearing may include an outer race, an inner race, and a roller. The inner race may define the inner opening. The roller may be located between the outer race and the inner race. In some embodiments, the hopping foot base may be the outer race of the bearing.

In some embodiments, the rotating guide may comprise a bearing and a passive drive system. The bearing may be coupled to the hopping foot base and may be configured to rotate about the axis. The bearing may be shaped to define a pointer. The passive drive system may be coupled to the bearing. The passive drive system may be configured to cause the bearing to rotate so that the pointer included in the bearing remains aligned with a path on the fabric as a user moves one of the fabric and the sewing machine during use of the sewing machine.

In some embodiments, the bearing may include an outer race, an inner race, and a roller. The roller may be located between the outer race and the inner race. In some embodiments, the hopping foot base may be the outer race of the bearing.

In some embodiments, the passive drive system may comprise a chassis, a wheel, and a spring. The chassis may be coupled to the bearing. The wheel may be coupled to the chassis opposite the pointer and may be configured to rotate about a wheel axis perpendicular to the axis of the rotating guide. The spring may be located between the bearing and the chassis. The spring may be configured to bias the wheel into engagement with the fabric during use of the sewing machine.

In some embodiments, the rotating guide may further comprise a guide insert. The guide insert may be configured to be selectively coupled to an inner opening of the bearing.

In some embodiments, the guide insert may be shaped to define the needle opening and a plurality of guide lines. The guide lines may be configured to be aligned with the path to allow the user to follow the path with the needle.

These and other features of the present disclosure will become more apparent from the following description of the illustrative embodiments.

DETAILED DESCRIPTION OF THE DRAWINGS

Figure 1:
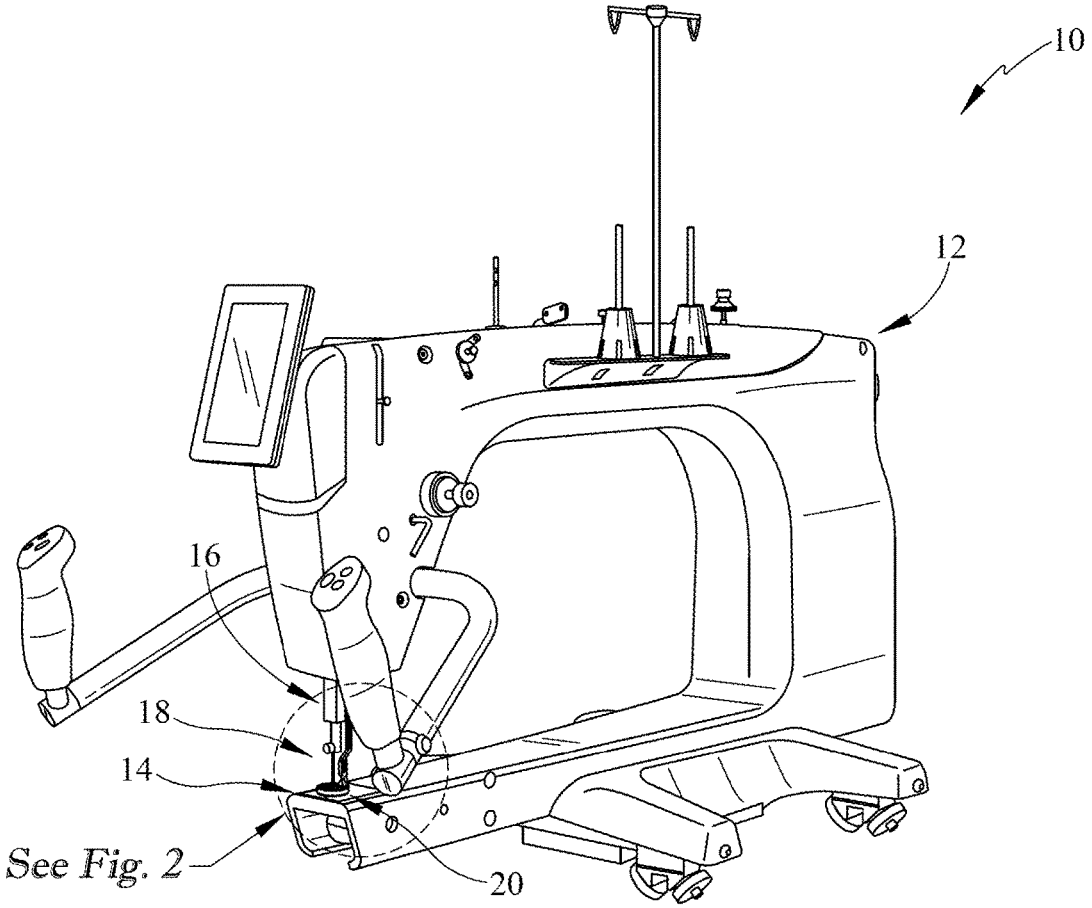
FIG. 1 is a perspective view of a sewing machine with a hopping foot assembly coupled to a presser bar of the sewing machine.

For the purposes of promoting an understanding of the principles of the disclosure, reference will now be made to a number of illustrative embodiments illustrated in the drawings and specific language will be used to describe the same.

Figure 2:
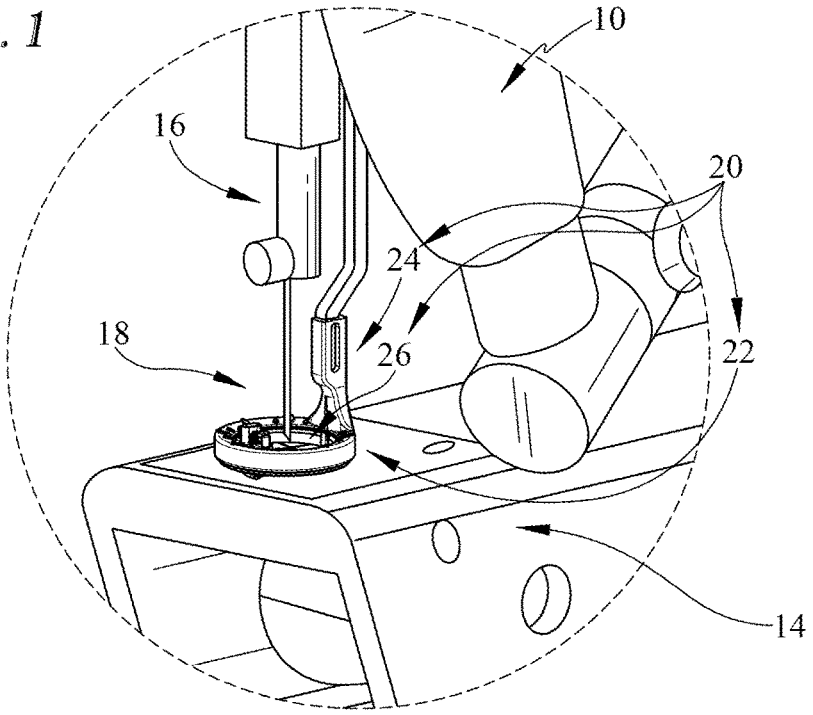
FIG. 2 is a detail view of the sewing machine of FIG. 1 showing the hopping foot assembly includes a hopping foot base shaped to include an opening that extends therethrough, a hopping foot arm that extends from the hopping foot base and couples to the sewing machine to fix the hopping foot base relative to the sewing machine, and a rotating guide arranged in the opening of the hopping foot base that aids a user in aligning a needle of the sewing machine with a path to be stitched in the fabric.
Figure 3:
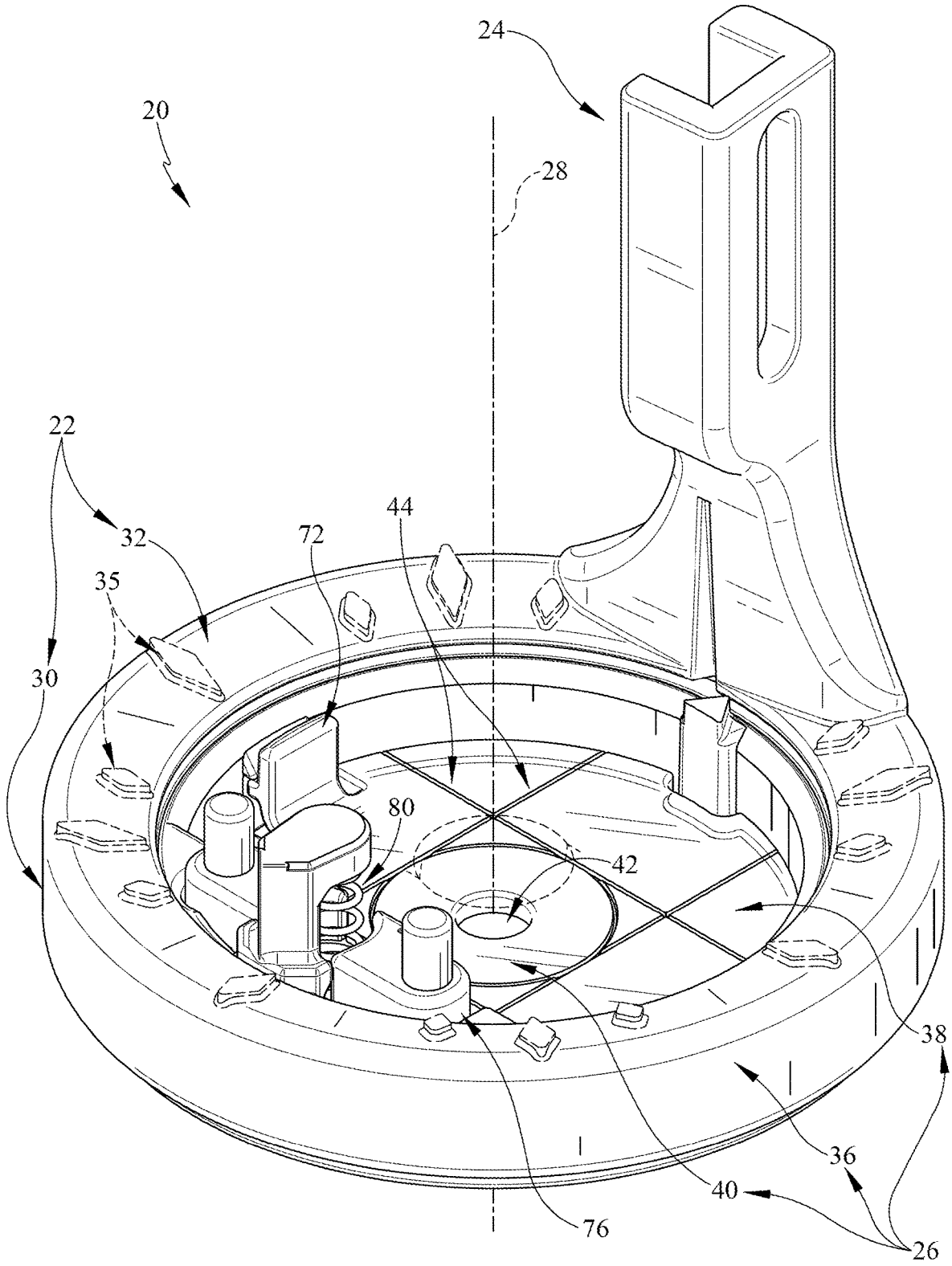
FIG. 3 is a perspective view of the hopping foot assembly of FIG. 2 showing the rotating guide is configured to rotate about an axis in response to movement of the hopping foot base to self-align the needle of the sewing machine with a stitching path or ditch line.

A hopping foot assembly 20 adapted for use with a sewing machine 10 is shown in FIGS. 1-10. The sewing machine 10 has a sewing machine body 12, sewing machine bed 14, a presser bar 16, and a needle 18 as shown in FIGS. 1 and 2. The hopping foot assembly 20 is coupled to the presser bar 16 of the sewing machine 10 and configured to be lowered into contact with fabric 19 to be sewn.

The hopping foot assembly 20 includes a hopping foot base 22, a hopping foot arm 24, and a rotating guide 26 as shown in FIGS. 2-10. The hopping foot base 22 is circular and is shaped to define an opening 34 that extends through the base 22 relative to an axis 28. The hopping foot arm 24 extends axially from the hopping foot base 22 and couples to the presser bar 16 of the sewing machine 10 to fix the hopping foot base 22 relative to the sewing machine 10. The rotating guide 26 is located in the opening 34 of the hopping foot base 22. In the illustrative embodiment, the rotating guide 26 is shaped to include a needle opening 42 configured to allow the needle 18 to extend into and out of the fabric 19.

When sewing or quilting pieces of fabric 19 together, it may be difficult for a user to accurately guide a hopping foot and thus the needle 18 of the machine 10 along a path 21, such as a seam, a ditch line, or other path, without straying from the path 21. This is especially true for free moving machines, which allow the user to freely move the machine 10 along the path 21.

The user may use a ruler to help guide the hopping foot along the path 21. It may be difficult, however, to maneuver the machine 10 and the ruler simultaneously. Further, using rulers may require constant reposition before changing directions.

As such, the rotating guide 26 is configured to rotate about the axis 28 relative to the hopping foot base 22 in response to movement of one of the fabric 19 and the sewing machine 10 during use of the sewing machine 10. In this way, the rotating guide 26 self-aligns the needle 18 of the sewing machine 10 with the path 21 without the use of the ruler.

The rotating guide 26 includes a bearing 36, a guide insert 38, and a passive drive system 40 as shown in FIGS. 3-10. The bearing 36 is coupled to the hopping foot base 22 and configured to rotate relative to the hopping foot base 22 about the axis 28. The guide insert 38 is transparent and is configured to be selectively coupled to an inner opening 49 of the bearing 36. The guide insert 38 is shaped to define the needle opening 42 and a plurality of guide lines 44 that allow the user to align the needle 18 with the path 21 to be stitched in the fabric 19. The passive drive system 40 is coupled to the bearing 36 and is configured to cause the bearing 36 to rotate in response to movement of the fabric 19 or the machine 10.

The passive drive system 40 causes the bearing 36 to rotate so that at least one guide line 44 of the plurality of guide lines 44 included in the guide insert 38 remains aligned with the path 21 as the user moves the fabric 19 or the sewing machine 10. As the user maneuvers the fabric 19 or the machine 10, the passive drive system 40 follows or trails the motion of the fabric 19 or the machine 10. In the illustrative embodiment, the passive drive system 40 trails the movement of the machine 10 as the user freely moves the machine 10.

Figure 7:
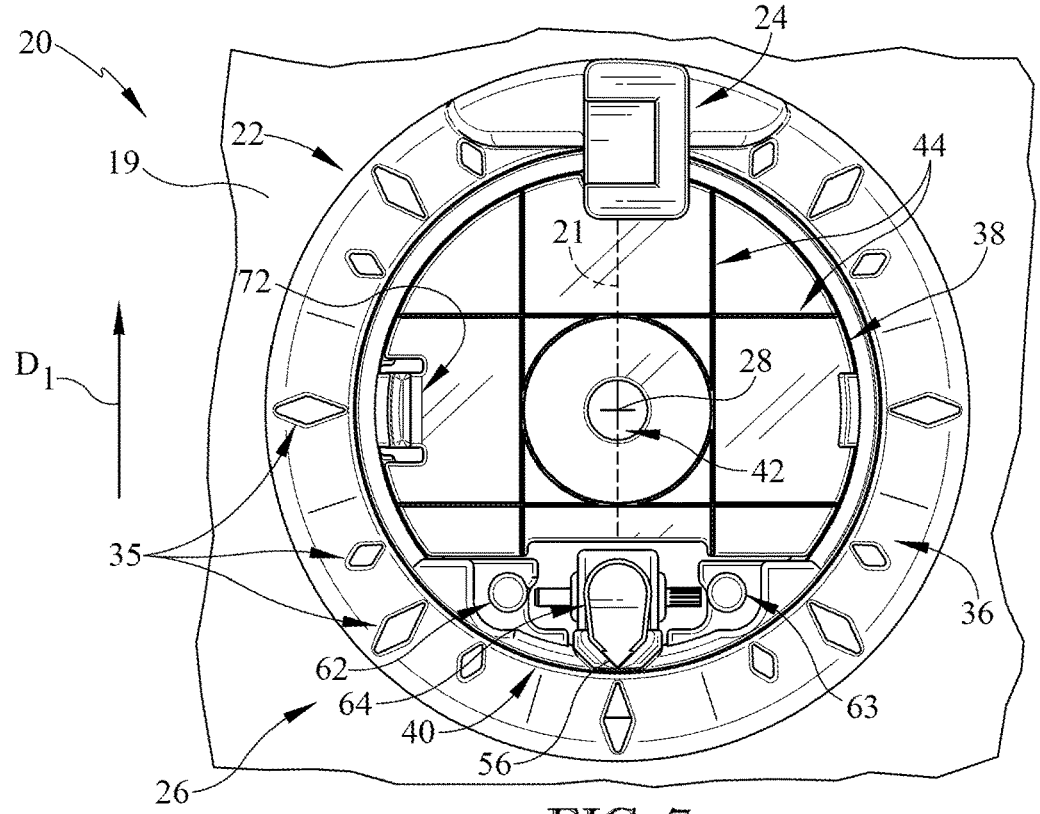
FIG. 7 is a top view of the hopping foot assembly of FIG. 2 showing the machine moving in a first direction which causes the rotating guide to be in a first position.
Figure 8:
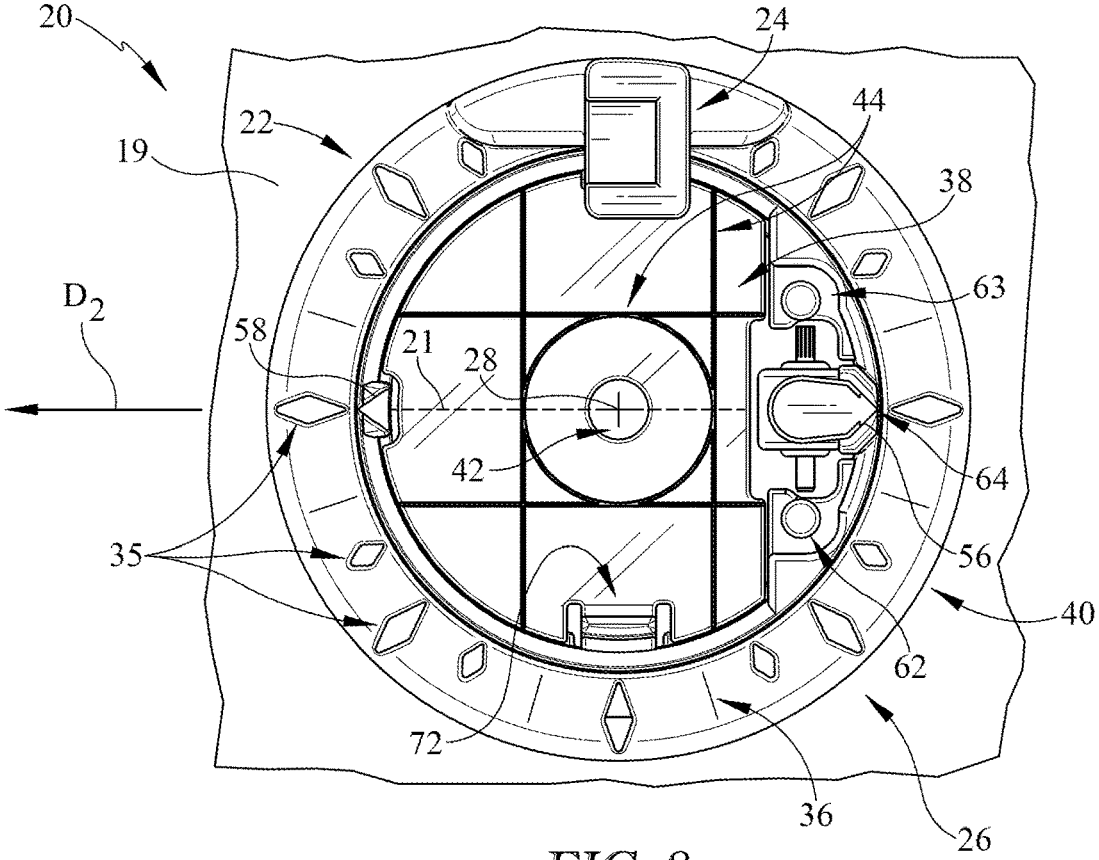
FIG. 8 is a view similar to FIG. 7 showing the machine moving in a second direction which has caused the rotating guide to rotate from the first position to a second position.

As the passive drive system 40 begins to follow the movement of the machine 10, the passive drive system 40 causes the bearing 36 to rotate as shown in FIGS. 7-10. For instance, as the machine 10 moves in a first direction $D_1$, the passive drive system 40 causes the bearing 36 to rotate to a first position as shown in FIG. 7. As the user changes the direction of the machine 10 from the first direction $D_1$ to a second direction $D_2$, the passive drive system 40 causes the bearing 36 to rotate to a second position as shown in FIG. 8.

Figure 9:
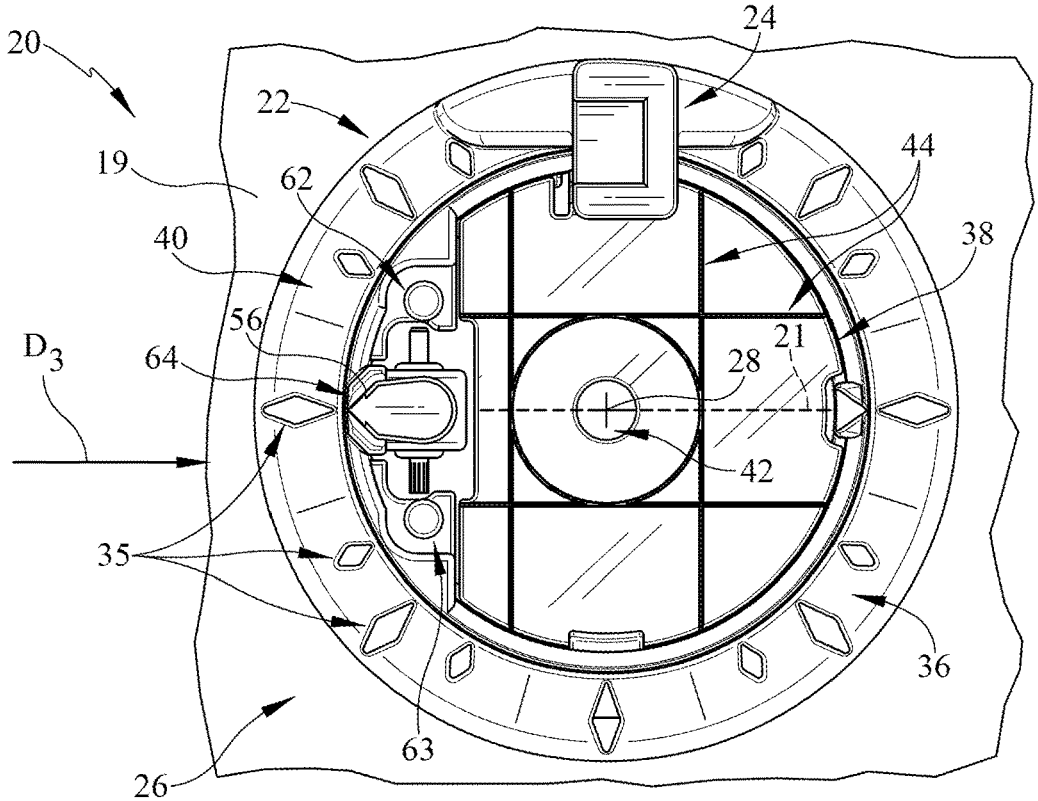
FIG. 9 is a view similar to FIG. 7 showing the machine moving in a third direction which has caused the rotating guide to rotate from the first position to a third position.
Figure 10:
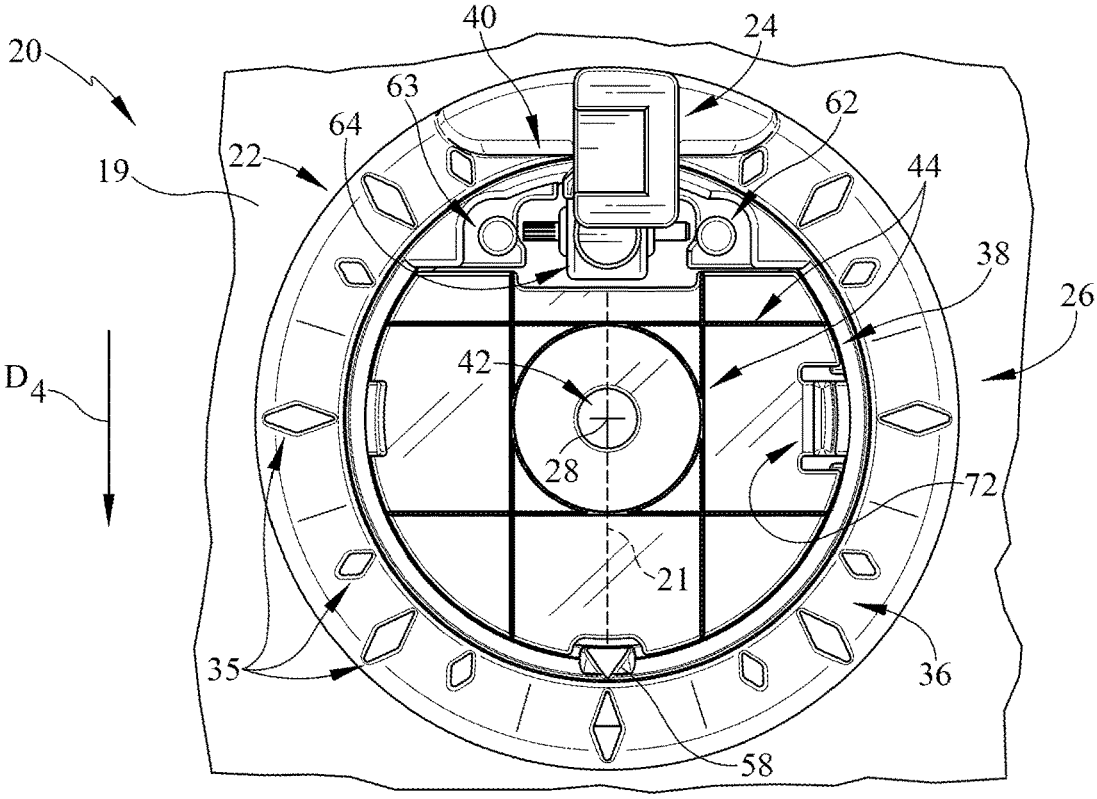
FIG. 10 is a view similar to FIG. 7 showing the machine moving in a fourth direction which has caused the rotating guide to rotate from the first position to a fourth position.

Similarly, as the user changes the direction of the machine 10 from the first direction $D_1$ to a third direction $D_3$, the passive drive system 40 causes the bearing 36 to rotate to a third position as shown in FIG. 9. Additionally, as the user changes the direction of the machine 10 from the first direction $D_1$ to a fourth direction $D_4$, the passive drive system 40 causes the bearing 36 to rotate to a fourth position as shown in FIG. 10.

The second and third positions of the rotating guide 26 are offset 90 degrees from the first position as shown in FIGS. 7-9. The fourth position is 180 degrees from the first position as shown in FIG. 10. The rotating guide 26 is also configured to move to a plurality of positions between the first position, the second position, the third position, and the fourth position.

In the illustrative embodiments, the plurality of positions may include angled positions such that the hopping foot assembly 20 may follow an angled path. The angled positions may be offset at an angle to any one of the first, second, third, or fourth positions.

Figure 4:
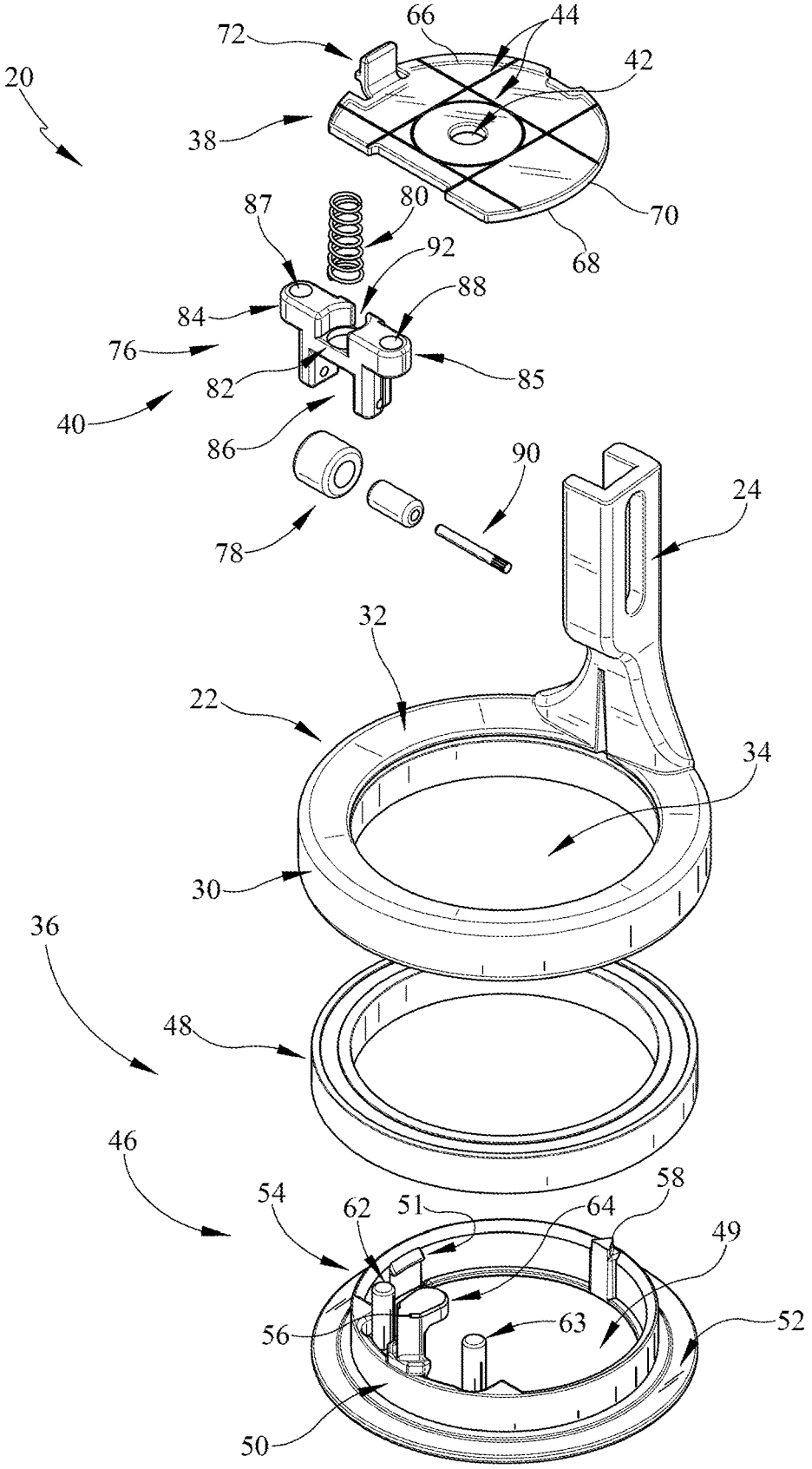
FIG. 4 is an exploded view of the hopping foot assembly of FIG. 3 showing the rotating guide includes a bearing coupled to the hopping foot base that rotates about the axis of the hopping foot assembly, a transparent guide insert configured to be selectively coupled to the bearing in an opening of the bearing, and a passive drive system coupled to the bearing to cause the bearing to rotate so that the guide attachment remains aligned with the ditch line as the user moves one of the fabric and the sewing machine during use of the sewing machine without a use of a ruler.
Figure 5:
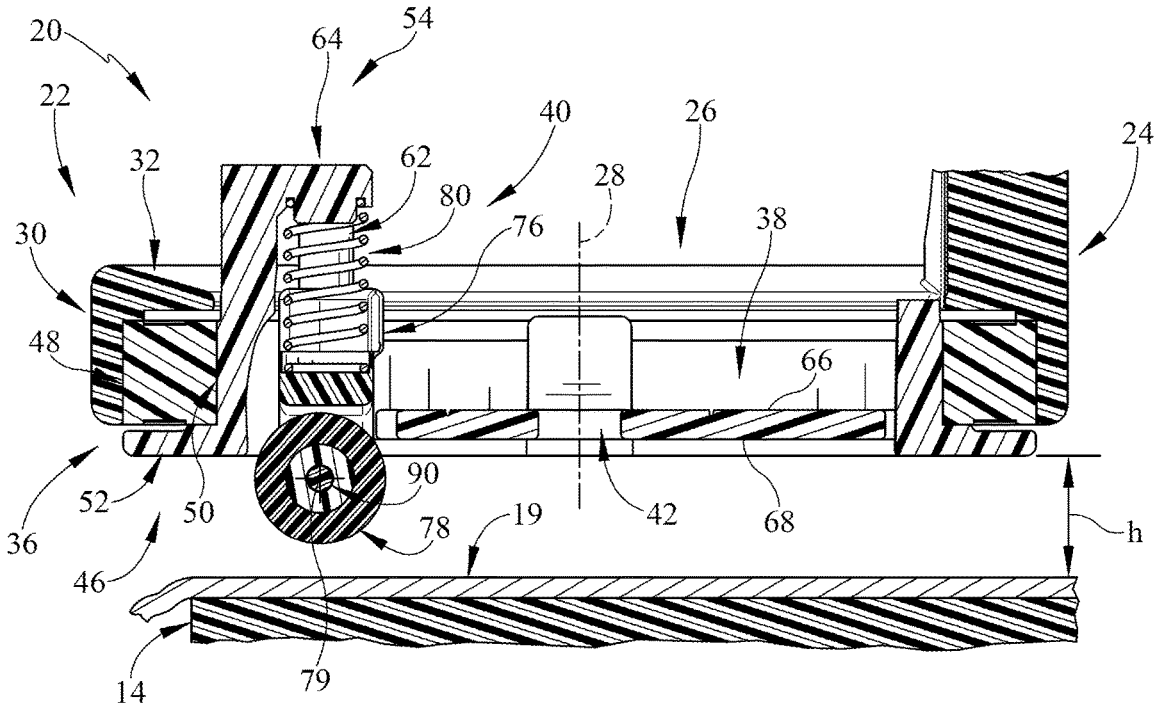
FIG. 5 is a cross-section view of the hopping foot assembly of FIG. 3 showing the drive system includes a chassis coupled to the bearing, a wheel coupled to the chassis that extends below a bottom surface of the hopping foot base so as to engage the fabric, and a spring located between the bearing and the chassis that biases the wheel into engagement with the fabric.
Figure 6:
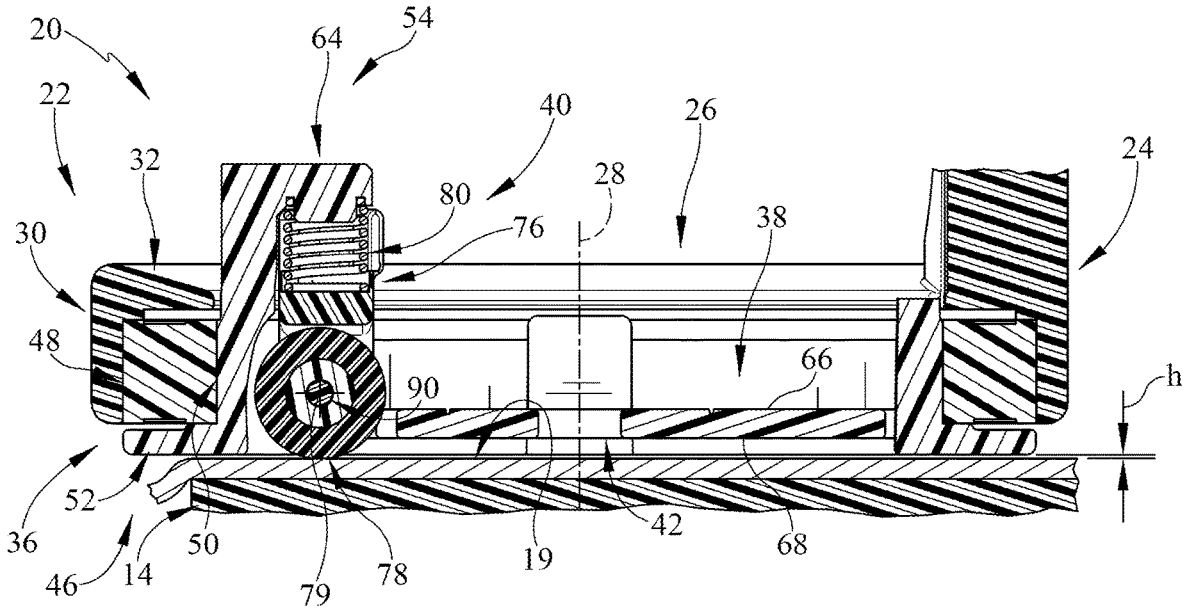
FIG. 6 is a view similar to FIG. 5 showing the hopping foot assembly lowered toward the sewing machine so that the wheel is engaged with fabric on the sewing machine.

Turning again to the rotating guide 26, the bearing 36 includes an outer race, an inner race 46, and a roller 48 as shown in FIGS. 4-6. The inner race 46 defines the inner opening 49 of the bearing 36. The roller 48 is located between the outer race and the inner race 46. In the illustrative embodiments, the hopping foot base 22 forms the outer race of the bearing 36 and the inner race 46 is configured to rotate between the different positions based on the direction of the machine 10.

In other embodiments, the hopping foot base 22 may be coupled to the outer race of the bearing 36. In other embodiments, the inner race 46 may be a separate component from the bearing 36 that is coupled to a different inner race of the bearing 36.

The inner race 46 includes a cylinder portion 50, a flange portion 52, and a drive system mount 54 as shown in FIGS. 4-6. The cylinder portion 50 extends around the axis 28 and defines a portion of the inner opening 49 of the bearing 36.

The flange portion 52 extends radially outward from an inner end of the cylinder portion 50 relative to the axis 28. The roller 48 is located between hopping foot base 22 and the inner race 46 such that the cylinder portion 50 and the flange portion 52 support the roller 48. The drive system mount 54 extends from the cylinder portion 50 into the inner opening 49 and is configured to couple the drive system 40 to the bearing 36.

The drive system mount 54 includes base portion 60, pegs 62, 63, and a top portion 64 as shown in FIGS. 4-10. The base portion 60 extends from the cylinder portion 50 into the inner opening 49 and is parallel to the flange portion 52. Each of the pegs 62, 63 extends axially relative to the axis 28, away from the base portion 60. The pegs 62, 63 are in spaced apart relation to each other. The top portion 64 extends axially relative to the axis 28 from an outer end of the cylinder portion 50. The top portion 64 is positioned between the pegs 62, 63.

In some embodiments, the outer race or the hopping foot base 22 includes a plurality of angular indicators 35 as suggested in FIGS. 3 and 7-10. The angular indicators 35 allow the user to follow the path 21 on the fabric 19, whether it is straight or angled.

In the illustrative embodiment, the inner race 46 is further shaped to include direction indicators, or pointers 56, 58 as shown in FIGS. 4 and 7-10. The first pointer 56 is located the inner race 46 opposite the drive system mount 54. The second pointer 58 is located on the drive system mount 54 on an opposite side of the first pointer 56 such that the second pointer 58 is aligned with the first pointer 56. The second direction indicator 58 points opposite the first direction indicator 56.

Each of the pointers 56, 58 are configured to be aligned with the path 21 or with one of the angular indicators 35 formed on the hopping foot base 22 as suggested in FIGS. 7-10. The pointers 56, 58 may be directly aligned with the path 21 as the user moves the sewing machine 10 to allow the user to follow the path 21 with the needle 18. Additionally, the pointers 56, 58 may be aligned with any one of the angular indicators 35 so that the user may follow the path 21 that extends at an angle.

The drive system 40 includes a chassis 76, a wheel 78, and a spring 80 as shown in FIGS. 3-10. The chassis 76 is configured to mate with the drive system mount 54 of the inner race 46 to couple the chassis 76 to the bearing 36. The wheel 78 is coupled to the chassis 76 so that the wheel 78 extends below a bottom surface of the flange portion 52 and engages the fabric 19 on the machine bed 14. The spring 80 is located between the bearing 36 and the chassis 76 so as to bias the wheel 78 into engagement with the fabric 19 during use of the sewing machine 10.

The wheel 78 is configured to rotate about a wheel axis 79 as shown in FIGS. 5 and 6. The wheel axis 79 is perpendicular to the axis 28 of the rotating guide 26. As the fabric 19 or the sewing machine 10 is moved, the wheel 78 follows or trails the direction $D_1$, $D_2$, $D_3$, $D_4$ that either the fabric 19 or sewing machine 10 is moving.

In other embodiments, the wheel 78 of the drive system 40 may be a fin that slides along the fabric 19 to cause the bearing 36 to rotate in response to movement of the fabric 19 or the machine 10. In other embodiments, the wheel 78 may be another suitable driving mechanism to cause the bearing 36 to rotate in response to movement of the fabric 19 or the machine 10.

The chassis 76 includes a mounting base 82, mounting flanges 84, 85, and a fork 86 as shown in FIG. 4. The mounting flanges 84, 85 extend in opposite directions from the mounting base 82 and engage the drive system mount 54 to couple the mounting base 82 to the inner race 46 of the bearing 36. Each mounting flange 84, 85 includes a through hole 87, 88 that receives the corresponding peg 62, 63 of the drive system mount 54. The fork 86 extends axially from the mounting base 82 toward the flange portion 52 of the inner race 46. The fork 86 is configured to support the wheel 78 on an axle 90. The axle 90 extends through the fork 86 and the wheel 78 to couple the wheel 78 to the chassis 76, while allowing the wheel 78 to rotate about the wheel axis 79.

The mounting base 82 is shaped to include a notch 92 as shown in FIG. 4. The notch 92 is located between the mounting flanges 84, 85. The notch 92 receives the spring 80 to hold it in place at an inner end of the spring 80.

The top portion 64 of the drive system mount 54 extends over the mounting base 82 in a spaced apart relation to the mounting base 82 as shown in FIGS. 5 and 6. The top portion 64 is spaced apart from the mounting base 82 over the notch 92 to locate the spring 80 therebetween. The top portion 64 of the drive system mount 54 engages an outer end of the spring 80 so that the spring 80 is located between the top portion 64 and the mounting base 82.

Before sewing or quilting, the user may adjust the height h of the hopping foot assembly 20 relative to the machine bed 14 as suggested in FIGS. 5 and 6. As the hopping foot assembly 20 is lowered, the wheel 78 engages the fabric 19 on the machine bed 14. To allow the flange portion 52 of the inner race 46 to be nearly flush with the fabric 19, the chassis 76 is configured to slide relative to the bearing 36.

The chassis 76 slides axially along the pegs 62, 63 of the drive system mount 54 so that the hopping foot assembly 20 may be lowered as to engage the fabric 19 as shown in FIG. 6. As the chassis 76 translates axially along the pegs 62, 63, the spring 80 compresses between the top portion 64 and the mounting base 82. The spring 80 then biases the chassis 76 axially inward so that the wheel 78 maintains engagement with the fabric 19.

Turning again to the hopping foot base 22, the hopping foot base 22 includes a cylinder portion 30 and a flange portion 32 as shown in FIGS. 4-6. The cylinder portion 30 extends around the axis 28 to define the opening 34 and forms a bottom surface of the hopping foot base 22. The flange portion 32 extends radially outward from an outer end of the cylinder portion 30 relative to the axis 28 and forms a top surface of the hopping foot base 22.

The cylinder portion 30 of the hopping foot base 22 and the cylinder portion 50 of the inner race 46 are parallel to each other when assembled so that the roller 48 is located therebetween as shown in FIGS. 5 and 6. The flange portion 32 of the hopping foot base 22 is spaced apart from the flange portion 52 of the inner race 46 to locate the roller 48 therebetween. In the illustrative embodiment, the flange portion 32 of the hopping foot base 22 is shaped to include the angular indicators 35 as suggested in FIGS. 3 and 7-10.

The guide insert 38 is further shaped to include a top surface 66, a bottom surface 68, an outer edge 70, and an attachment clip 72 as shown in FIGS. 4-6. The top surface 66 is shaped to include the plurality of guide lines 44. The bottom surface 68 is spaced apart from the top surface 66 and the outer edge 70 extends between and interconnects the top and bottom surfaces 66, 68. The needle opening 42 extends through the top and bottom surfaces 66, 68 of the insert 38. The attachment clip 72 extends from the outer edge 70 and engages with inner race 46 of the bearing 36 to couple the guide insert 38 to the inner race 46.

In some embodiments, the guide lines 44 are contrasted lines using different contrasting colors. The contrasted lines make the guide lines 44 more visible to the user on the fabric 19. In other embodiments, the guide lines 44 may be groves that extend into the top surface 66 of the guide insert 38.

In the illustrative embodiment, a portion of the outer edge 70 is shaped to account for the drive system 40 as shown in FIGS. 4-6. In this way, the guide insert 38 does not interfere with the drive system 40, while still providing the guide lines 44 to aid the user.

In the illustrative embodiment, the cylinder portion 50 of the inner race 46 is shaped to include a tab 51 as shown in FIG. 4. The tab 51 engages with the attachment clip 72 of the guide insert 38 to couple the guide insert 38 with the inner race 46. The attachment clip 72 is compliant so that when the guide insert 38 is arranged in the inner opening 49 of the inner race 46, the attachment clip 72 bends before engaging with tab 51 radially under the tab 51.

To remove the guide insert 38, the attachment clip 72 may be bent away from the cylinder portion 50 so that the attachment clip 72 does not engage with the tab 51. The guide insert 38 is then removed and a different guide insert 38 may be coupled in the inner opening 49 of the bearing 36.

In some embodiments, the guide insert 38 may be removed and not used while sewing the fabric 19. In such embodiments, the user may align the pointers 56, 58 on the rotating guide 26 with the path 21 or with the indicators 35 on the hopping foot base 22 to keep the needle 18 aligned with the path 21.

The path 21 may be a ditch line in the between different fabric pieces 19. In other embodiments, the path 21 may be a seem in the fabric 19. In other embodiments, the path 21 may be a design or other pattern that the user wishes to add to the fabric 19.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A hopping foot assembly for a sewing machine having a needle, the hopping foot assembly comprising:

a circular hopping foot base shaped to include a top surface, a bottom surface spaced apart from the top surface that faces fabric to be sewn, and an opening that extends axially through the top and bottom surfaces relative to an axis;

a hopping foot arm that extends axially from the hopping foot base relative to the axis and configured to be coupled to the sewing machine to fix the hopping foot base relative to the sewing machine; and a rotating guide coupled to the hopping foot base in the opening of the hopping foot base and shaped to include a needle opening configured to allow the needle to extend into and out of fabric during use of the sewing machine;

wherein the rotating guide is configured to rotate about the axis relative to the hopping foot base in response to movement of one of the fabric and the sewing machine to allow a user to align the needle of the sewing machine with a path to be stitched in the fabric during use of the sewing machine, and wherein the rotating guide comprises:

a bearing coupled to the hopping foot base and configured to rotate about the axis; and a guide insert configured to be selectively coupled to an inner opening of the bearing, the guide insert shaped to define the needle opening and a plurality of guide lines configured to be aligned with the path to allow the user to follow the path with the needle.

2. The hopping foot assembly of claim 1, wherein the rotating guide further comprises:

the bearing shaped to define the inner opening; and a passive drive system coupled to the bearing and configured to cause the bearing to rotate so that at least one guide line of the plurality of guide lines included in the guide insert remains aligned with the path as the user moves one of the fabric and the sewing machine during use of the sewing machine.

3. The hopping foot assembly of claim 2, wherein the passive drive system comprises:

a chassis coupled to the bearing;

a wheel coupled to the chassis and configured to rotate about a wheel axis perpendicular to the axis of the rotating guide; and a spring located between the bearing and the chassis and configured to bias the wheel into engagement with the fabric during use of the sewing machine.

4. The hopping foot assembly of claim 2, wherein the bearing includes an outer race, an inner race that defines the inner opening, and a roller located between the outer race and the inner race, and wherein the hopping foot base is the outer race of the bearing.

5. The hopping foot assembly of claim 4, wherein the inner race of the bearing includes a pointer and the hopping foot base is shaped to include a plurality of angular indicators configured to be aligned with the pointer of the rotating guide so that the user may follow the path that extends at an angle.

6. The hopping foot assembly of claim 2, wherein the guide insert is transparent.

7. The hopping foot assembly of claim 1, wherein the rotating guide comprises:

the bearing shaped to define a pointer; and a passive drive system coupled to the bearing and configured to cause the bearing to rotate so that the pointer included in the bearing remains aligned with the path as the user moves one of the fabric and the sewing machine during use of the sewing machine.

8. The hopping foot assembly of claim 7, wherein the bearing includes an outer race, an inner race, and a roller located between the outer race and the inner race, and wherein the hopping foot base is the outer race of the bearing.

9. The hopping foot assembly of claim 7, wherein the passive drive system comprises:

a chassis coupled to the bearing;

a wheel coupled to the chassis opposite the pointer and configured to rotate about a wheel axis perpendicular to the axis of the rotating guide; and a spring located between the bearing and the chassis and configured to bias the wheel into engagement with the fabric during use of the sewing machine.

10. The hopping foot assembly of claim 1, wherein the guide insert is transparent.

11. A hopping foot assembly for a sewing machine having a needle, the hopping foot assembly comprising:

a hopping foot base shaped to include an opening that extends axially through the hopping foot base relative to an axis;

a hopping foot arm that extends axially from the hopping foot base relative to the axis and configured to be coupled to the sewing machine to fix the hopping foot base relative to the sewing machine; and a rotating guide coupled to the hopping foot base in the opening of the hopping foot base and shaped to include a needle opening configured to allow the needle to extend into and out of fabric during use of the sewing machine, wherein the rotating guide is configured to rotate about the axis relative to the hopping foot base in response to movement of one of the fabric and the sewing machine, and wherein the rotating guide comprises;

a bearing coupled to the hopping foot base and configured to rotate about the axis; and a guide insert configured to be selectively coupled to an inner opening of the bearing, the guide insert shaped to define the needle opening and a plurality of guide lines configured to be aligned with the path to allow the user to follow the path with the needle.

12. The hopping foot assembly of claim 11, wherein the guide insert is transparent.

13. The hopping foot assembly of claim 11, wherein the rotating guide comprises:

the bearing shaped to define the inner opening; and a passive drive system coupled to the bearing and configured to cause the bearing to rotate so that at least one guide line of the plurality of guide lines included in the guide insert remains aligned with the path as the user moves one of the fabric and the sewing machine during use of the sewing machine.

14. The hopping foot assembly of claim 13, wherein the passive drive system comprises:

a chassis coupled to the bearing;

a wheel coupled to the chassis and configured to rotate about a wheel axis perpendicular to the axis of the rotating guide; and a spring located between the bearing and the chassis and configured to bias the wheel into engagement with the fabric during use of the sewing machine.

15. The hopping foot assembly of claim 13, wherein the bearing includes an outer race, an inner race that defines the inner opening, and a roller located between the outer race and the inner race, and wherein the hopping foot base is the outer race of the bearing.

16. The hopping foot assembly of claim 11, wherein the rotating guide comprises:

the bearing shaped to define a pointer; and a passive drive system coupled to the bearing and configured to cause the bearing to rotate so that the pointer included in the bearing remains aligned with the path as the user moves one of the fabric and the sewing machine during use of the sewing machine.

* * * * *